US006592344B2

(12) United States Patent
Witham et al.

(10) Patent No.: US 6,592,344 B2
(45) Date of Patent: Jul. 15, 2003

(54) PRESS-ON INSULATOR DISH

(75) Inventors: Robert Carl Witham, Arkadelphia, AR (US); Marvin Wayne Burchfield, Hot Springs, AR (US); Gregory W. Hahn, Arkadelphia, AR (US); Brad Allen Meeks, Bridge City, TX (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/997,329

(22) Filed: Nov. 29, 2001

(65) Prior Publication Data

US 2003/0099564 A1 May 29, 2003

(51) Int. Cl.[7] ..... F04C 18/04
(52) U.S. Cl. ..... 418/55.1; 418/83; 417/310
(58) Field of Search ..... 418/55.1, 83; 29/888.022; 417/310

(56) References Cited

U.S. PATENT DOCUMENTS 4,904,165 A * 2/1990 Fraser et al. ..... 418/55.1
5,487,654 A * 1/1996 Wallis et al. ..... 418/55.1

* cited by examiner

*Primary Examiner*—John J. Vrablik
(74) *Attorney, Agent, or Firm*—Carlson, Gaskey & Olds

(57) ABSTRACT

The present invention is for the retention of a heat shield for a scroll compressor. In one embodiment, the heat shield is deformed into a position such that it rests in a groove located in the non-orbiting scroll. In another embodiment the housing end cap deforms the heat shield. The deformed position of the heat shield prevents flexing and vibrating found in heat shields of prior art. In addition the heat shield must have holes in it to allow for the discharge valve to pass through. The present invention is to put slots in the heat shield, thus preventing the need for exact alignment of the heat shield in position.

19 Claims, 4 Drawing Sheets

PRESS-ON INSULATOR DISH

BACKGROUND OF THE INVENTION

The present invention relates to the retention of a heat shield in a sealed scroll compressor by creating a bias force on the heat shield.

Modern refrigerant compressors are typically contained within a sealed shell. The compressors are frequently divided into two compartments, a discharge chamber and a suction chamber.

A scroll compressor is one common type of sealed compressor. In a scroll compressor an orbiting scroll and a non-orbiting scroll each have a base, with generally spiral wraps extending from the bases. The orbiting scroll and the non-orbiting scroll are placed together such that the wraps create compression chambers. A shaft connected to a motor drives the orbiting scroll. As the orbiting scroll orbits the volume of the compression chambers is decreased.

Refrigerant is compressed in the chambers and discharged into the discharge chamber through a discharge port located in the non-orbiting scroll. The refrigerant may reach high temperature within the discharge chamber.

Historically, a thick separator plate isolated the discharge chamber from the base of the non-orbiting scroll. More recently, scroll compressor designs have attempted to eliminate the separator plate.

However, without a separator plate the refrigerant in the discharge chamber comes into contact with the base of the non-orbiting scroll. The refrigerant heats the base and consequently the compression chambers, which costs efficiency. A relatively thin heat shield has been placed extending about the base of the non-orbiting scroll. Due to the operation of the scroll compressor, there are pressure and temperature differences on each side of the heat shield. The pressure and temperature differences may create vibration and flexing of the thin heat shield.

One other concern is the heat shield may need to have openings, such as to allow flow from a pressure relief valve. In the past this has required that the heat shield be precisely aligned within the compressor such that the opening in the heat shield is aligned over the pressure relief valve to facilitate flow.

SUMMARY OF THE INVENTION

In embodiments of this invention a heat shield is associated within the base of a non-orbiting scroll. As known, the heat shield provides a barrier to insulate the non-orbiting scroll from the hot refrigerant in the discharge chamber. To address the above mentioned concern the heat shield is held at a deformed position such that a bias force resists flexing or vibration.

In a preferred embodiment a groove is placed in a boss surrounding a discharge port in the non-orbiting scroll. The heat shield is deformed into the groove. In a free state, the heat shield has a disc like appearance. An opening in the center of the heat shield is received over the boss. The heat shield is placed on the boss and pressed down. Essentially there is an interference fit between the heat shield and the boss. This fit deforms the heat shield away from its free curved shape creating a spring pre-load. The bias force from the deformation keeps the heat shield in position resisting flexing or vibration.

Preferably the inner edge of the heat shield is held in position in a groove located in the boss. The groove may have several different configurations. In the preferred configuration the bottom side of the groove is flat with a radius at the corner. The edge extends upward and is angled slightly toward the outside of the scroll. The angle prevents the heat shield from moving out of the groove.

In another embodiment the groove can be square cut. This groove has a distinct bottom, side, and top portion. This groove provides good support from the top when holding the heat shield in place. A third embodiment includes an angled groove, which has only two sides. The bottom side of the groove is flat, and a side extends upwardly and outwardly.

An alternative to having a curved heat shield is an embodiment where the outside edge of the heat shield is turned upward. The outside edge contacts the upper end cap when installed, deforming the heat shield when the end cap is secured to the compressor housing. This contact creates a downward bias force on the heat shield. Again, the bias force resists flexing and vibrating of the heat shield following installation.

In another embodiment, the heat shield is captured between the non-orbiting scroll and the outer housing. A portion of the heat shield is deformed when held at this captured position such that the bias force as mentioned above does occur.

One other aspect of the invention provides a heat shield, which more easily accommodates components such as a pressure relief valve. The valve requires a hole to be placed in the heat shield allowing the flow to pass through. One known heat shield is used with a non-orbiting scroll having ribs on a rear face, with pockets between the ribs. There is usually a hole in the heat shield through which the flow from the pressure relief valve may pass. However the single hole has needed to be aligned over the pressure relief valve. This aspect of the invention allows for the adjustments to be made in the alignment of the heat shield and the relief valve. In one aspect the hole aligned over the pressure relief valve can be a slot to allow for the valve and the heat shield to be slightly misaligned and still allow flow through the hole. There may also be a plurality of holes within an area of the heat shield, or a series of spaced holes in the heat shield. The holes may be off center within the heat shield again to allow for misalignment.

These and other features of the present invention can be best understood from the following specification and drawings.

BRIEF DESCRIPTION OF THE DRAWINGS

The following drawings describe the invention in an illustrative manner, by way of example only.

DETAILED DESCRIPTION OF THE PREFERRED EMBODIMENT

Figure 1:
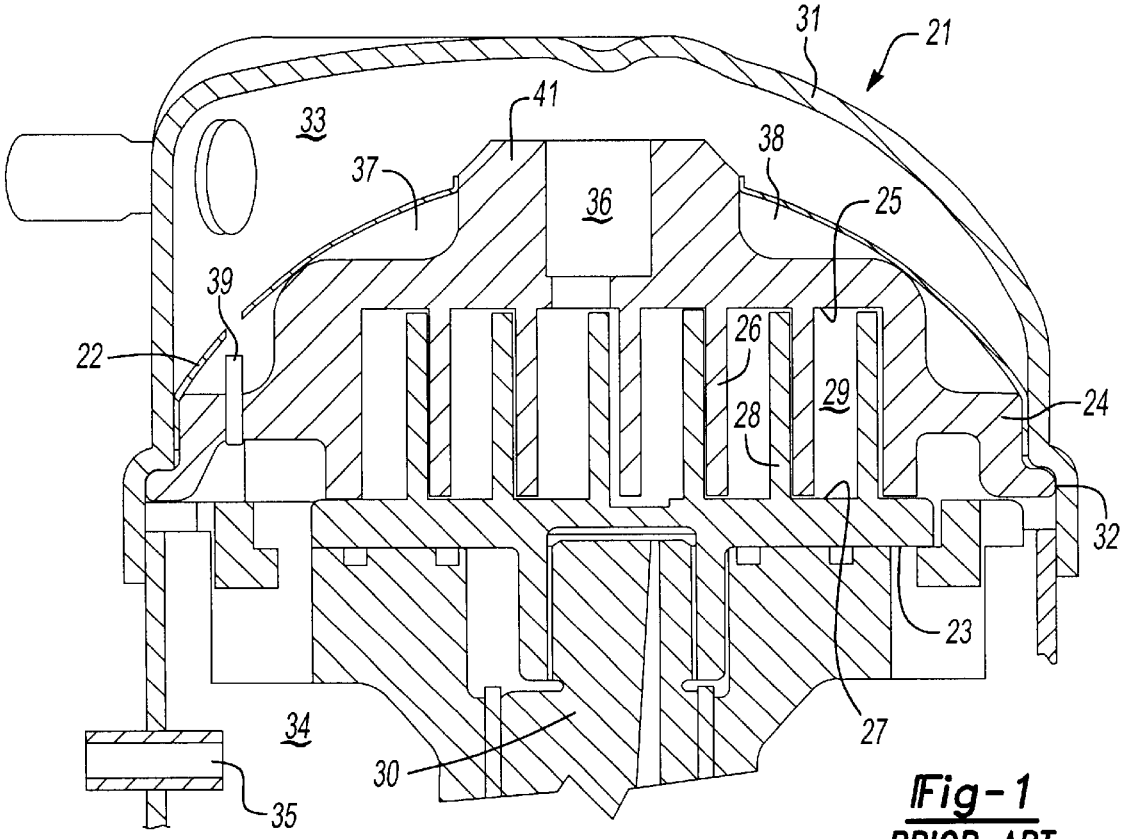
Fig-1 PRIOR ART
FIG. 1 shows a prior art scroll compressor

A known scroll compressor 21 includes a heat shield 22, as shown in FIG. 1. Scroll compressor 21 includes an orbiting scroll 23 and a non-orbiting scroll 24. Non-orbiting scroll 24 has a base 25, with generally spiral wraps 26 extending from the base. Likewise orbiting scroll 23 has a base 27 with generally spiral wraps 28. The orbiting scroll 23 and the non-orbiting scroll 24 are placed together and the wraps 26 and 28 create compression chambers 29. A shaft 30 connected to a motor drives orbiting scroll 23, and as this occurs the volume of the compression chambers 29 is decreased.

The non-orbiting scroll 24 is sealed to the outer housing end cap 31 of the compressor 21 in the area of 32, thus creating two separate chambers, a discharge chamber 33 and a suction chamber 34. Suction pressure refrigerant passes through suction tube 35 and enters chamber 34. Thus, the non-orbiting scroll 24 provides the function of a separator plate. Refrigerant is compressed in chambers 29 and discharged into discharge chamber 33 through a discharge port 36 located in the non-orbiting scroll 24.

The refrigerant in discharge chamber 33 is at a relatively high temperature. A heat shield 22 is used to insulate the base of the non-orbiting scroll 24 from the heat of the discharge chamber 33. This in turn insulates the refrigerant in the compression chambers 29 from the heat. The heat shield 22 is a relatively thin component extending about the base 25 of the non-orbiting scroll 24 with chambers 37 and 38 between the base 25 and the heat shield 22.

A pressure difference often exists across the heat shield 22 due to the variance in pressure and temperature on each side of the heat shield 22. A pressure relief valve 39 may extend from non-orbiting scroll 24. Also the discharge of refrigerant into chamber 33 is somewhat cyclic and causes cyclic pressure variation in chamber 33. As a result of the pressure differences the heat shield 22 may vibrate or flex in its position, thus creating noise. The compressor described to this point is generally as disclosed in U.S. patent application entitled "Scroll Compressor with Heat Shield" (U.S. Pat. No. 6,287,089)

Figure 2:
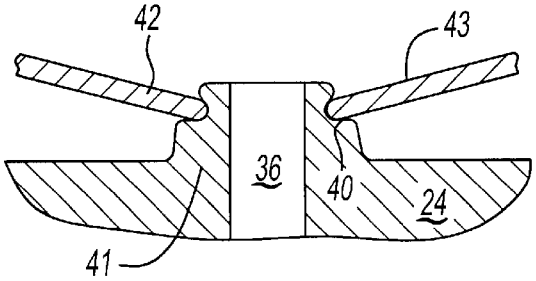
FIG. 2 shows a side view of a heat shield according to the present invention prior to installation

To address the above noise the heat shield of this invention is deformed so as to be biased into either the base 25, or an end cap 31. As shown in FIG. 2, groove 40 is formed in a boss 41 in non-orbiting scroll 24 to receive an inner end 42 of heat shield 43. As explained below, the heat shield 43 is held at this position with a bias force.

Figure 3A:
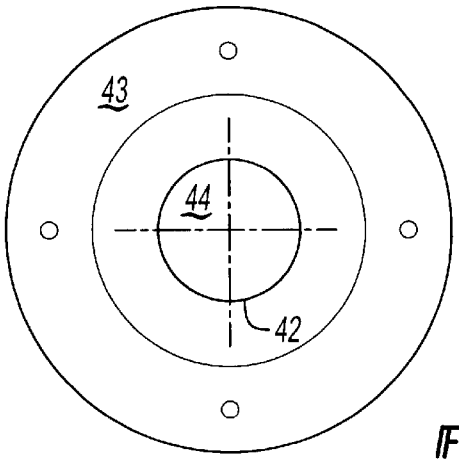
FIG. 3A is a top view of a heat shield according to the present invention
Figure 3B:
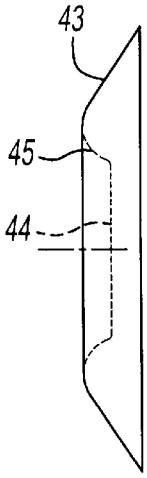
FIG. 3B is a side view of heat shield according to the present invention

In the preferred embodiment of the invention the heat shield 43 has a free shape with a disc like appearance, as shown FIG. 3A. As can be seen there is a cut out area 44 in the center of the heat shield 43 along inner end 42. The curved shape of the disk is shown in FIG. 3B as having an upwardly extending curved shape 45.

Figure 4:
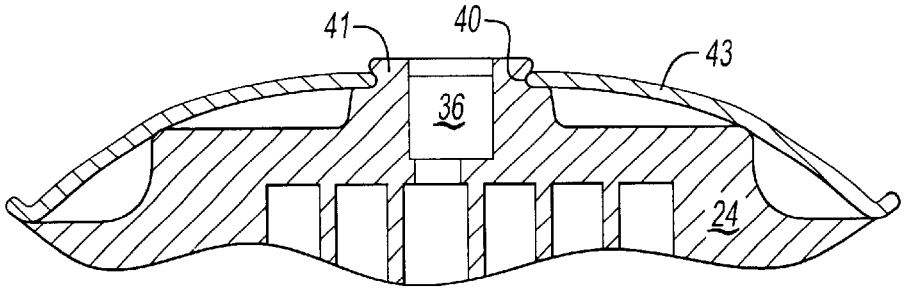
FIG. 4 is a side view of heat shield following installation on the scroll compressor

Opening 44 allows heat shield 43 to fit over a boss 41 extending from the top of the fixed scroll 24, as shown in FIG. 2. Once the heat shield 43 had been placed on boss 41 it is pressed down. The curved shape 45 of the heat shield 43, as shown in FIG. 3B, is forced downwardly with groove 40 providing an interference fit. When the shield is forced to its operative position, as shown in FIG. 4, a spring bias is created trying to move the heat shield back to the FIG. 2 position.

Figure 5:
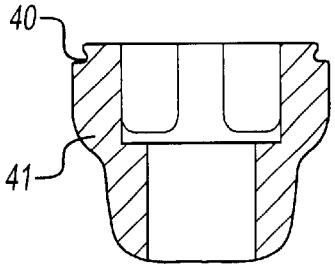
FIG. 5 shows a cross-section of the non-orbiting scroll boss showing location of the heat shield groove.
Figure 6:
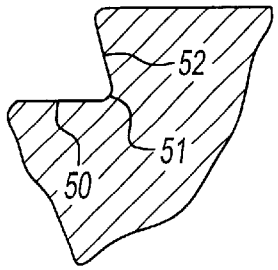
FIG. 6 is a side view of the preferred embodiment of the heat shield groove

The preferred location of the groove 40 in the boss 41 is shown in FIG. 5. FIG. 6 shows the preferred shape of the groove 40. The groove 40 may have several different configurations. The bottom side 50 of the groove 40 is flat with a radius 51 at the corner. The edge extending upward 52 is angled slightly toward the outside of the scroll. The angle prevents the heat shield from moving out of the groove 40.

Figure 7:
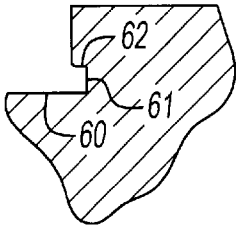
FIG. 7 shows a side view of an alternative embodiment of the heat shield groove

In another embodiment the groove 40 can be square cut, shown in FIG. 7. This groove has a distinct bottom 60, side 61, and top portion 62. This more distinct groove provides good support from the top when holding the heat shield 43 in place.

Figure 8:
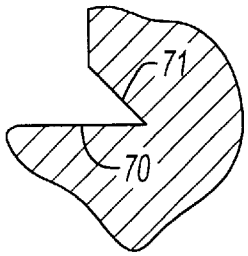
FIG. 8 is a side view of a third embodiment of the heat shield groove

As shown in FIG. 8, a third embodiment shows an angled groove, which has only two sides. The bottom side 70 of the groove being flat, and a side 71 extending upward and outward from that.

Figure 9:
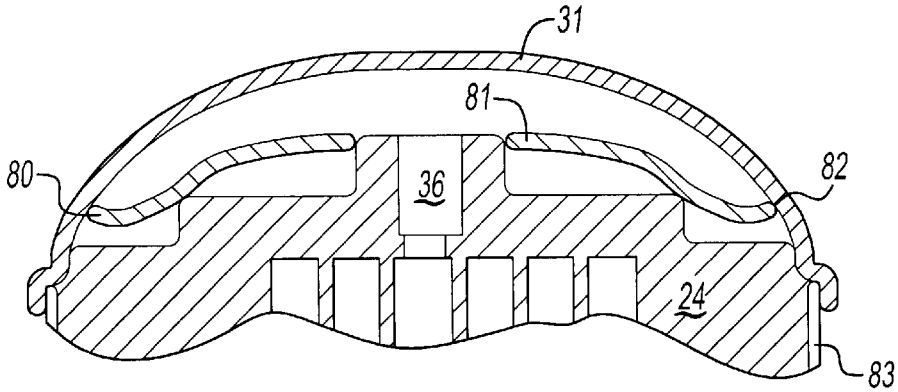
FIG. 9 is a side view of an alternate embodiment of the invention, after installation on the scroll compressor

FIG. 9 shows another embodiment where the outside edge 80 of a heat shield 81 is turned upward. An upper end cap 31 contacts the outward edge 80 at 82. This contact creates a downward bias force on the heat shield 81. Once the upper end cap 31 is welded to center shell 83 the heat shield 81 is deformed by this contact. Again this creates a bias force resisting flexing and vibrating of the heat shield.

Figure 10A:
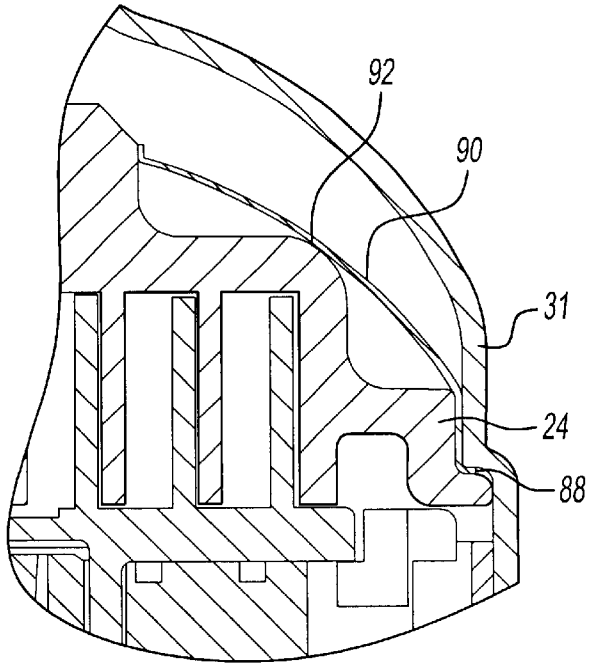
FIG. 10A shows a cross-sectional view of another embodiment.

As shown in FIG. 10A, a non-orbiting scroll 24 and an outer housing end cap 31 capture a shoulder portion 88 of a heat shield 90. Such a heat shield is better described in U.S. Pat. No. 6,428,293, the capturing aspect of which is incorporated herein by reference.

The heat shield 90 as disclosed in this invention preferably has a contact point 92 contacting a portion of the non-orbiting scroll 24. This contact point leads to some deformation in the heat shield 90, such that the benefits mentioned above are achieved.

Figure 10B:
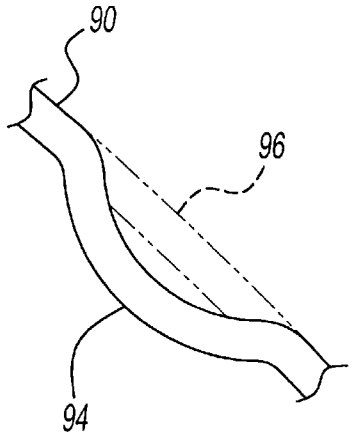
FIG. 10B shows an undeformed portion of the FIG. 10A embodiment.

As shown in FIG. 10B, the heat shield 90 has an undeformed shape 94 which is deformed to the position 96 such as shown in phantom in 10B when the heat shield is captured between the non-orbiting scroll 24 and the end cap 31. When held in this position, a bias force tending to bias the heat shield back against the non-orbiting scroll is created, providing the benefits as mentioned above.

The portion 94 may be one, or a plurality of circumferentially spaced portions which are deformed to the phantom position shown in 96, or could be a circumferentially continuous portion.

Figure 11:
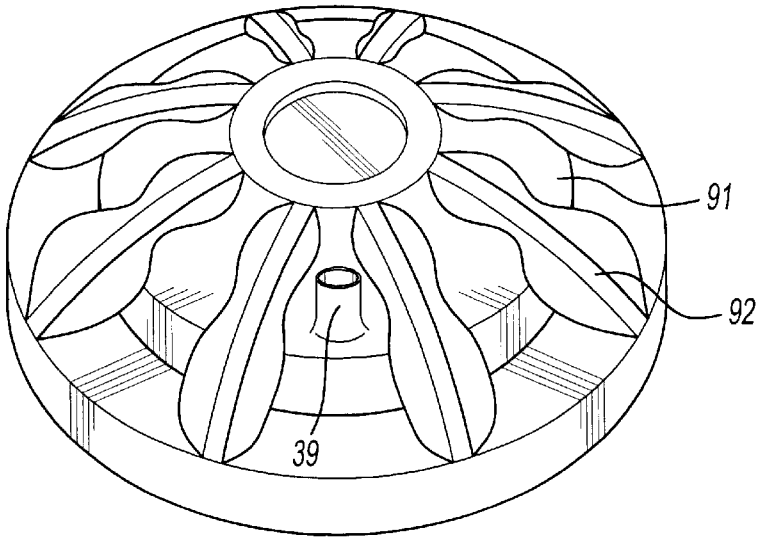
FIG. 11 is a top view of the non-orbiting scroll.
Figure 12:
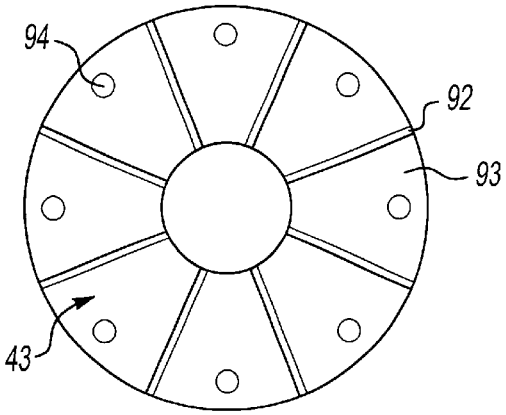
FIG. 12 is a top view of another embodiment heat shield.

There is also a requirement for the heat shield 43 to allow passage of flow from pressure relief valve 39. As can be seen from non-orbiting scroll shown in FIG. 11 there may be ribs 92 and pockets 91 around pressure relief valve 39. Likewise the heat shield 43 has ribs 92 running across it, between the ribs 92 there are pockets 93. In order to fit, the heat shield 43 requires a hole 94 in one of its pockets 93 allowing the flow from the pressure relief valve 39 to pass through. In another aspect of this invention, the holes 94 have been modified in order to accommodate for misalignment of the heat shield 43 and the pressure relief valve 39. FIG. 12 shows an embodiment of this with one hole 94 within each pocket 93 of the heat shield. With this feature, the heat shield does not require being particularly aligned with the non-orbiting scroll.

Figure 13:
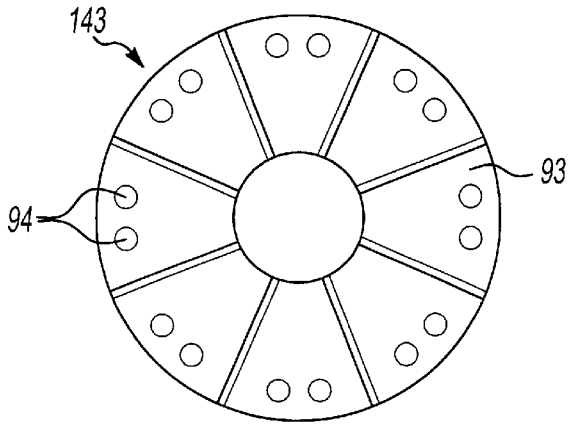
FIG. 13 shows a top view of another embodiment heat shield.
Figure 14:
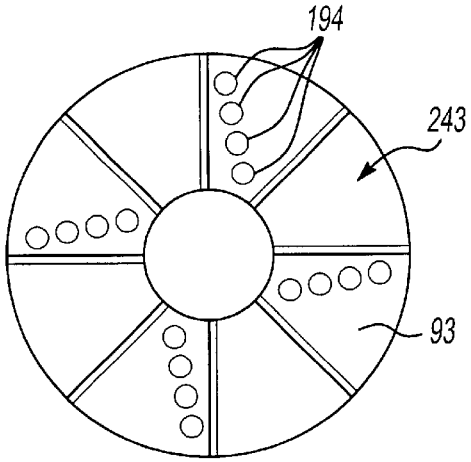
FIG. 14 shows a top view of another embodiment heat shield.

In another embodiment there may be a plurality of holes in a pocket 93, as shown in FIGS. 13 and 14. These holes 94 may be aligned so they are off center. Another embodiment shows that there may be holes in more than one of the ribs 92.

In FIG. 13 the holes 94 in the heat shield 143 are set off center within the pocket, allowing for a valve 39 that has been set off center to still be aligned to facilitate flow of gasses to pass through the holes 94. Furthermore the valve 39 may not be located the same distance from the center in every heat shield. FIG. 14 shows an embodiment 243 in which the holes 194 vary in distance from the center of the heat shield.

Figure 15:
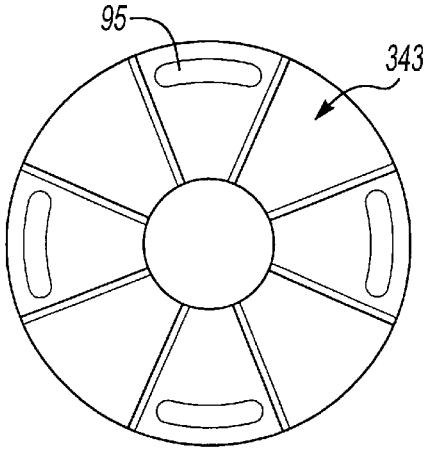
FIG. 15 shows a top view of yet another embodiment heat shield.

FIG. 15 shows another variation 343 for allowing misalignment of a flow valve 39 and the required hole in the heat shield 43 is to replace the holes with slots 95.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention

What is claimed is:

1. A scroll compressor assembly comprising;

a sealed housing including a center shell and an upper end cap;

a non-orbiting scroll having a base, and a generally spiral wrap extending from said base;

an orbiting scroll, having a base and generally spiral wrap extending from its base to fit within said spiral wrap of non-orbiting scroll;

a motor to drive said orbiting scroll;

a discharge chamber formed within said sealed housing on one side of non-orbiting scroll;

a suction chamber formed within sealed housing on a second side of orbiting and non-orbiting scroll assembly;

said non-orbiting scroll having an outer peripheral surface sealed to an inner peripheral surface of said housing such that said non-orbiting scroll provides a separation between said suction chamber and said discharge chamber; and a heat shield between said upper end cap and said base of said non-orbiting scroll, said heat shield being deformed away from a free position to create a bias force holding said heat shield, said heat shield being exposed to discharge pressure refrigerant from said discharge chamber on a side of the heat shield removed from said non-orbiting scroll.

2. The compressor of claim 1 wherein an outer edge of said heat shield is turned upwardly, said upper end cap creating a bias force on said outward edge.

3. The compressor of claim 1 wherein a boss extends from said non-orbiting scroll into said discharge chamber, said heat shield having a hole in the center to fit over and attach to said boss of said non-orbiting scroll.

4. The compressor of claim 3 including at least one groove in said non-orbiting scroll boss for affixing said heat shield in position.

5. The compressor as described in claim 4 wherein said at least one groove are square-cut.

6. The compressor as described in claim 4 wherein said at least one groove are angled grooves.

7. The compressor as described in claim 4 where said at least one groove have a radial corner.

8. The compressor of claim 1 where said heat shield contains ribs such that there are pockets between said ribs, and a hole in said heat shield allowing multiple positions for the heat shield to be installed and still allows said pressure relief valve to pass through said hole.

9. The compressor of claim 8 wherein said hole is a slot.

10. The compressor of claim 8 wherein there is at least one said hole in each pocket.

11. The compressor of claim 8 wherein there are at least two said holes in at least one pocket.

12. The compressor of claim 11 wherein at least one of said holes is off-center.

13. The compressor of claim 1, wherein the heat shield is captured between said non-orbiting scroll and said upper end cap, and a portion of the heat shield is deformed against said non-orbiting scroll to create said bias force.

14. The compressor of claim 13 wherein said heat shield contains a hole in center allowing passage of a boss extending from said non-orbiting scroll, said boss containing at least one groove for affixing said heat shield in position.

15. A scroll compressor comprising;

a sealed housing including a center shell and an upper end cap, a non-orbiting scroll having a base and a generally spiral wrap extending from said base;

an orbiting scroll having a base and a generally spiral wrap extending from its base to fit within said spiral wrap of non-orbiting scroll;

a motor to drive said orbiting scroll;

a discharge chamber formed within sealed housing on other side of orbiting and non-orbiting scroll assembly;

a pressure relief valve extending from said base of non-orbiting scroll into said discharge chamber;

a heat shield between said upper end cap and said base of non-orbiting scroll said base containing ribs such that there are pockets between said ribs, said heat shield being deformed away from a free position to create a bias force holding said heat shield, said non-orbiting scroll having an outer peripheral surface sealed to an inner peripheral surface of said housing such that said non-orbiting scroll provides a separation between said suction chamber and said discharge chamber; and a hole in said heat shield such that it allows multiple positions for the heat shield to be installed and still allows said pressure relief valve to pass through said hole, said heat shield being exposed to discharge pressure refrigerant from said discharge chamber on a side of the heat shield removed from said non-orbiting scroll.

16. The compressor of claim 15 wherein said hole is a slot.

17. The compressor of claim 15 wherein said hole is off-center within said pocket.

18. The compressor of claim 15 wherein there is at least two holes associate with a pocket.

19. The compressor of claim 15 wherein there is at least one hole in every pocket.

* * * * *

UNITED STATES PATENT AND TRADEMARK OFFICE

CERTIFICATE OF CORRECTION

PATENT NO. : 6,592,344 B2
DATED : July 15, 2003
INVENTOR(S) : Robert Carl Witham et al.

It is certified that error appears in the above-identified patent and that said Letters Patent is hereby corrected as shown below:

Column 6,
Line 5, "are" should be -- is --
Line 7, "are angled grooves" should be -- is an angled groove --
Line 9, "have" should be -- has --
Line 13, "said" should be -- a --

Signed and Sealed this

Fourth Day of November, 2003

JAMES E. ROGAN
*Director of the United States Patent and Trademark Office*